US009505464B1

(12) United States Patent
Wood

(10) Patent No.: US 9,505,464 B1
(45) **Date of Patent: *Nov. 29, 2016**

(54) WAKE ADJUSTMENT SYSTEM FOR BOATS

(71) Applicant: Scott Wood, Lakewood Ranch, FL (US)

(72) Inventor: Scott Wood, Lakewood Ranch, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/845,902

(22) Filed: Sep. 4, 2015

Related U.S. Application Data

(60) Provisional application No. 62/114,202, filed on Feb. 10, 2015, provisional application No. 62/071,256, filed on Sep. 19, 2014.

(51) Int. Cl.
*G06F 17/00* (2006.01)
*B63B 1/22* (2006.01)
*B63B 35/85* (2006.01)

(52) U.S. Cl.
CPC ..... *B63B 1/22* (2013.01); *B63B 35/85* (2013.01); *B63B 2035/855* (2013.01)

(58) Field of Classification Search
CPC .... B63B 1/22; B63B 35/85; B63B 2035/855
USPC ..... 701/21, 426; 707/749; 709/201; 340/5.61
See application file for complete search history.

(56) References Cited

U.S. PATENT DOCUMENTS

| | | | | |
|---|---|---|---|---|
| 3,002,485 | A | 10/1961 | Curtis | |
| 3,200,782 | A | 8/1965 | Walden | |
| 3,391,667 | A | 7/1968 | Bue | |
| 3,399,643 | A | 9/1968 | Bennett | |
| 3,577,948 | A | 5/1971 | Frey | |
| 4,261,278 | A | 4/1981 | Gaudin | |
| 4,597,742 | A | 7/1986 | Finkl | |
| 4,781,634 | A * | 11/1988 | Harris | B63H 20/34 440/66 |
| 4,967,682 | A | 11/1990 | O'Donnell | |
| 5,058,520 | A | 10/1991 | Fahrney | |
| 5,385,110 | A | 1/1995 | Bennett et al. | |
| 5,390,623 | A | 2/1995 | Mackaness | |
| 5,474,013 | A | 12/1995 | Wittmaier | |
| 5,549,071 | A | 8/1996 | Pigeon et al. | |
| 5,732,665 | A * | 3/1998 | Morrison | B63H 1/28 123/41.01 |
| 5,752,864 | A * | 5/1998 | Jones | B63H 11/11 440/41 |
| 5,863,230 | A * | 1/1999 | Morrison | B63H 5/125 416/163 |
| 6,012,408 | A | 1/2000 | Castillo | |
| 6,095,077 | A | 8/2000 | DeAgro | |
| 6,105,527 | A | 8/2000 | Lochtefeld et al. | |
| 6,138,601 | A | 10/2000 | Anderson et al. | |
| 6,834,607 | B1 | 12/2004 | Johnson et al. | |
| 7,140,318 | B1 | 11/2006 | Gasper | |
| 7,252,047 | B1 | 8/2007 | Baucom | |
| 7,311,058 | B1 | 12/2007 | Brooks et al. | |
| 7,434,531 | B1 | 10/2008 | Zsido et al. | |

(Continued)

OTHER PUBLICATIONS

Williams, David; "First Look: Nautique Surf System"; Jan. 16, 2013; www.wakeworld.com/news/feature/first-look-nautique-surf-system.html.

*Primary Examiner* — McDieunel Marc
(74) *Attorney, Agent, or Firm* — Christopher M. Ramsey; GrayRobinson, P.A.

(57) ABSTRACT

A wake adjustment system for a boat may include a pair of wake adjustment devices mountable at the stern of the boat to deflect water moving past a stern trailing edge of the boat's running surface. A wake adjustment device includes a water deflector that is rotatable about a first pivot axis for varying a degree of wake adjustment. The pivot axis is non-parallel to the boat's stern trailing edge.

25 Claims, 9 Drawing Sheets

(56) References Cited

U.S. PATENT DOCUMENTS

| | | | | |
|---|---|---|---|---|
| 8,251,006 | B2 | 8/2012 | Kalil | |
| 8,387,551 | B2 | 3/2013 | Miller | |
| 8,403,715 | B1 * | 3/2013 | Arneson | B63H 11/08 440/38 |
| 8,480,445 | B2 * | 7/2013 | Morvillo | B63B 39/00 440/40 |
| 8,539,897 | B1 | 9/2013 | Gasper et al. | |
| 8,631,753 | B2 | 1/2014 | Morvillo | |
| 8,833,286 | B1 | 9/2014 | Sheedy et al. | |
| 8,857,356 | B1 | 10/2014 | Murphy | |
| 9,038,560 | B1 | 5/2015 | Brendel | |
| 9,067,644 | B2 | 6/2015 | Sheedy et al. | |
| 9,174,703 | B2 | 11/2015 | Sheedy et al. | |
| 2009/0165694 | A1 | 7/2009 | Beamer | |
| 2012/0079977 | A1 | 4/2012 | Gai | |

* cited by examiner

WAKE ADJUSTMENT SYSTEM FOR BOATS

CROSS-REFERENCE TO RELATED APPLICATIONS

This claims priority from provisional Application No. 62/114,202, filed Feb. 10, 2015, and provisional Application No. 62/071,256, filed Sep. 19, 2014, which are incorporated by reference in their entireties.

FIELD

This relates to the field of boats and, more particularly, to adjusting the wake a boat produces.

BACKGROUND

Watersports such as waterskiing, wakeboarding, and wakesurfing involve propelling a person behind a boat using the boat's power, but the optimal wake for each of these sports is different. In waterskiing, the wake is preferably as small as possible to provide a smooth skiing surface. In wakeboarding, the wake is preferably larger than it is for waterskiing to provide a ramp for aerial stunts. In wakesurfing, the wake should be high enough and have enough curl to propel a person surfing behind the boat without a rope.

In the past, watersports boats were not well-equipped to allow the boat operator to adjust the size and shape of the boat's wake. But in recent years, boat makers have developed wake shaping devices that allow the operator to tune the wake to meet the requirements of a particular watersport.

A watersport that has become very popular in the last several years is called wake surfing. In wake surfing, a person rides a board behind a boat and is propelled forward by surfing on the boat's wake. If the wake is large enough, one can surf the wake without being towed by a rope. Modern wake surfing systems generate surf wakes, essentially by digging a hole in the water behind and on one side of the boat. This washes out the wake produced by one side of the boat and creates surfable wave behind the boat.

SUMMARY

A wake adjustment system, a boat having wake adjustment capability, and a method of adjusting boat wake are described here in connection with a boat including a hull having a bottom side with a running surface extending from a bow to a stern along a longitudinal hull centerline.

An example of the wake adjustment system includes a pair of wake adjustment devices that are mountable to the stern in opposed positions about the centerline. Each wake adjustment device has a mounting member at the forward end of the device that can mount the device to the boat and an extension member having a forward edge connected to the mounting member. The extension member extends aft the mounting member to a first pivot axis that extends horizontally across the extension member from an outboard side to an inboard side thereof. The first pivot axis is non-parallel to the forward edge of the extension member. A water deflector is connected to the extension plate at the first pivot axis and is rotatable about the first pivot axis for varying a degree of wake adjustment.

An example the boat includes a pair of wake adjustment devices mounted to the boat aft the stern trailing edge in opposed positions about the centerline. Each wake adjustment device has a water deflector pivotally attached to the wake adjustment device along a first pivot axis that is non-parallel with the stern trailing edge. Each water deflector is rotatable about the pivot axis so as to modify the boat's wake. A control system in communication with each wake adjustment device is operable to impart rotation about each first pivot axis to each water deflector independent of the other water deflector to make a surf wake behind the boat.

A method of generating a surf wake behind a boat includes imparting rotation to a water deflector of a wake adjustment device mounted to a stern of a boat on either a port or starboard side of the centerline in such a way that the water deflector deflects water that moved past the stern trailing edge and creates a surf wake behind the boat. The water deflector is rotatably connected to the wake adjustment device at a pivot axis that extends horizontally across the wake adjustment device and is non-parallel with the stern trailing edge.

Certain examples of the wake adjustment device include a second pivot axis forward the first pivot axis. The second pivot axis allows for the device to be installed on boats having different shapes, such as differently sloped transoms.

DETAILED DESCRIPTION OF EMBODIMENTS

Figure 1:
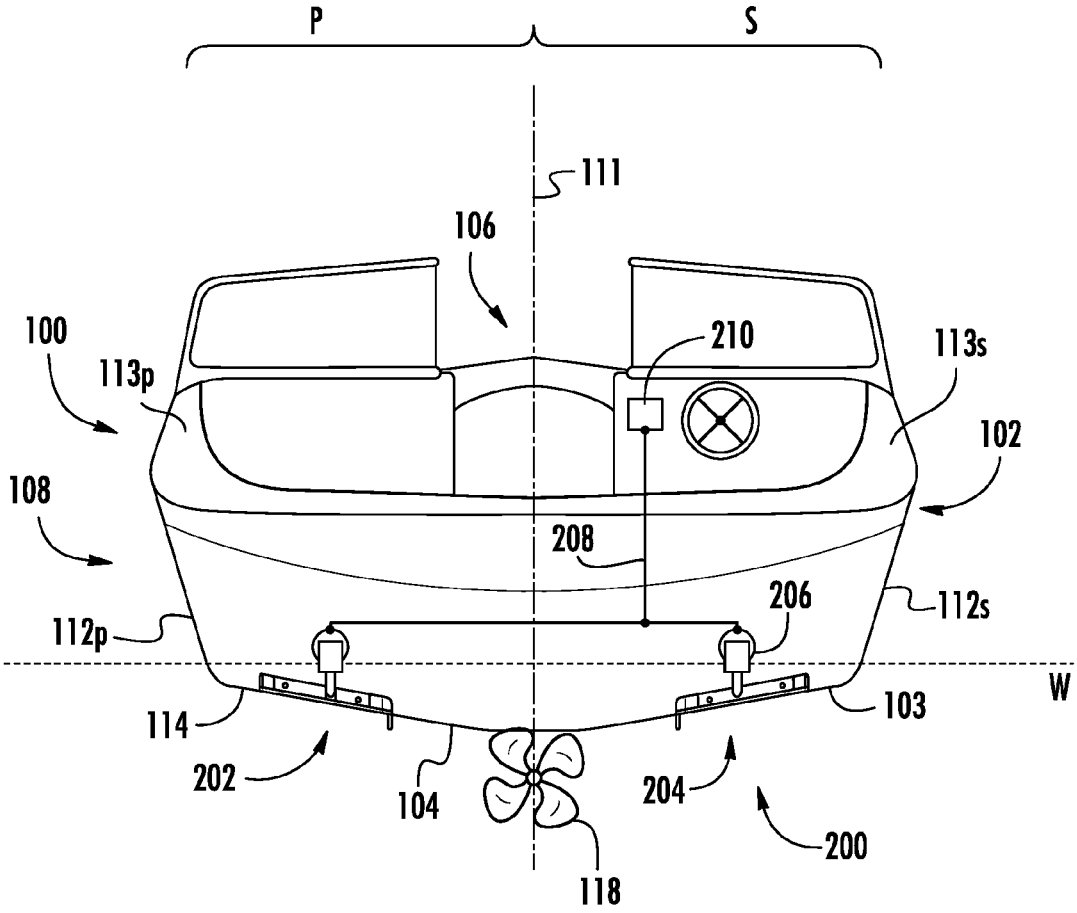
FIG. 1 is a stern view of a boat including an a wake adjustment system aspect.
Figure 2:
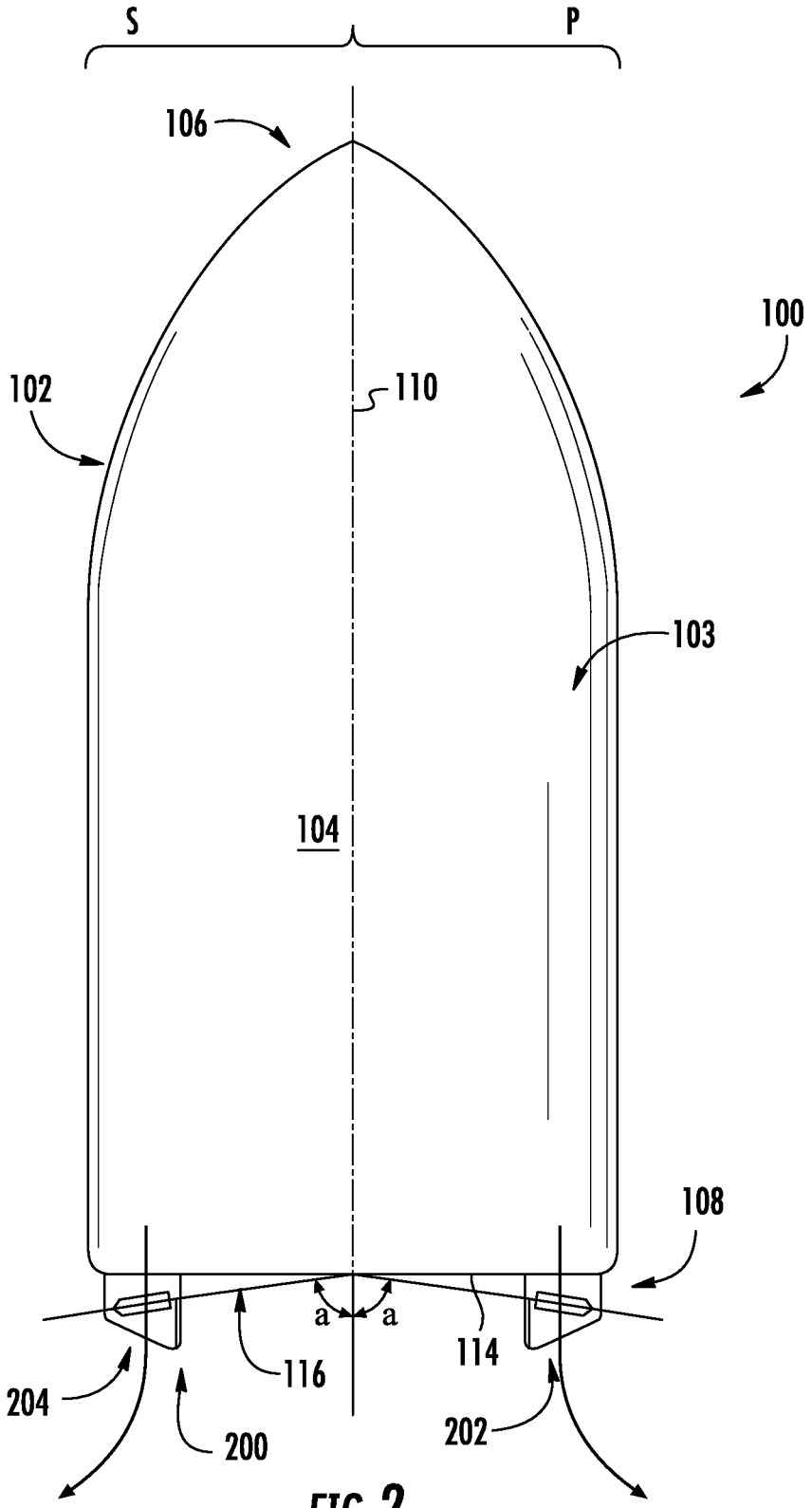
FIG. 2 is a bottom view of the boat of FIG. 1.
Figure 3:
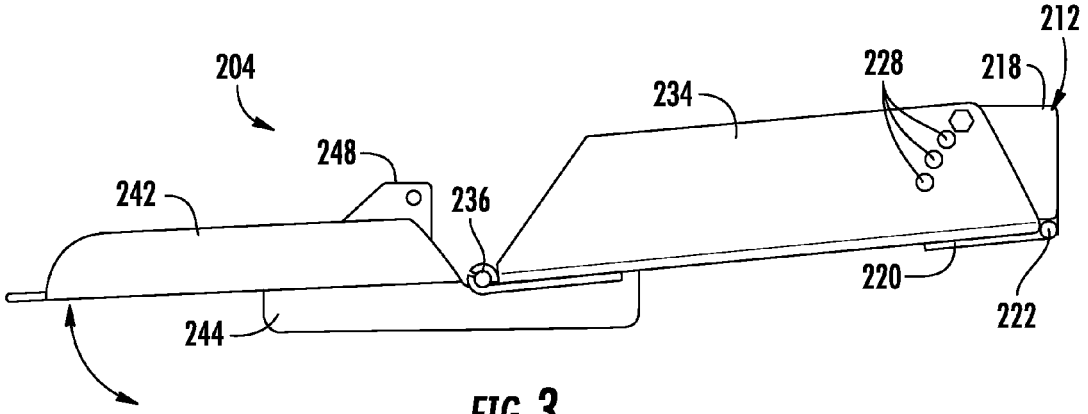
FIG. 3 is an outboard side view of an example of a starboard side wake adjustment device.
Figure 4:
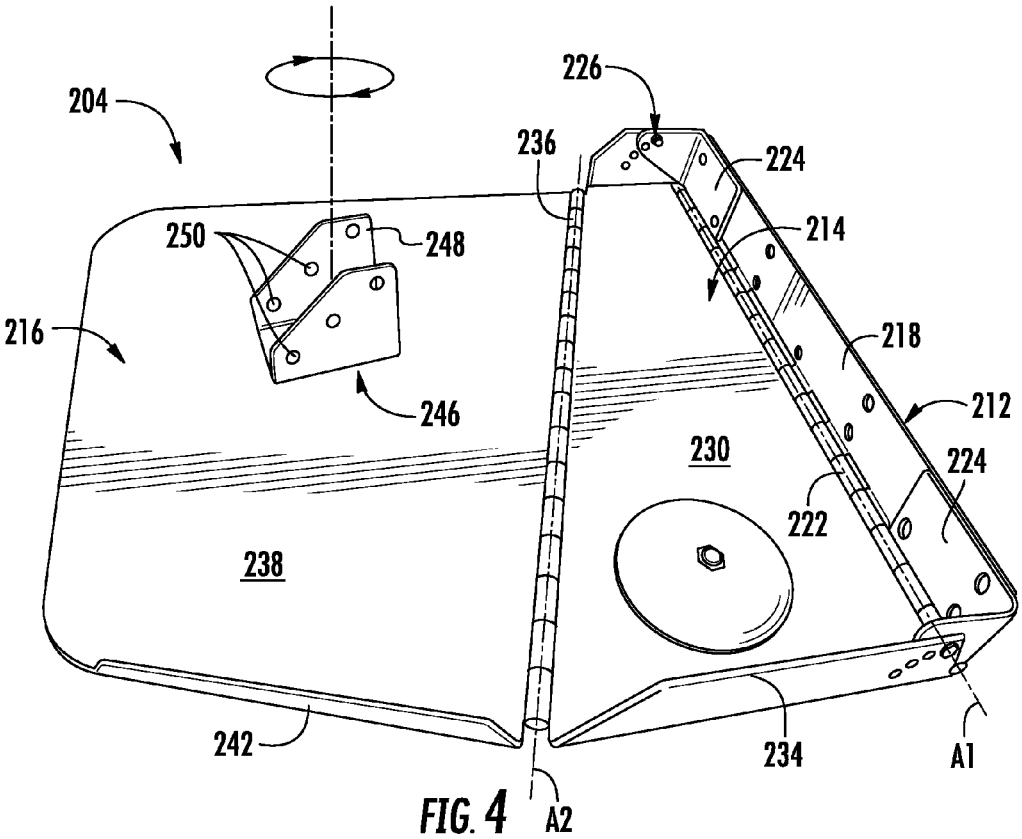
FIG. 4 is a top perspective outboard side view of the wake adjustment device of FIG. 3.
Figure 5:
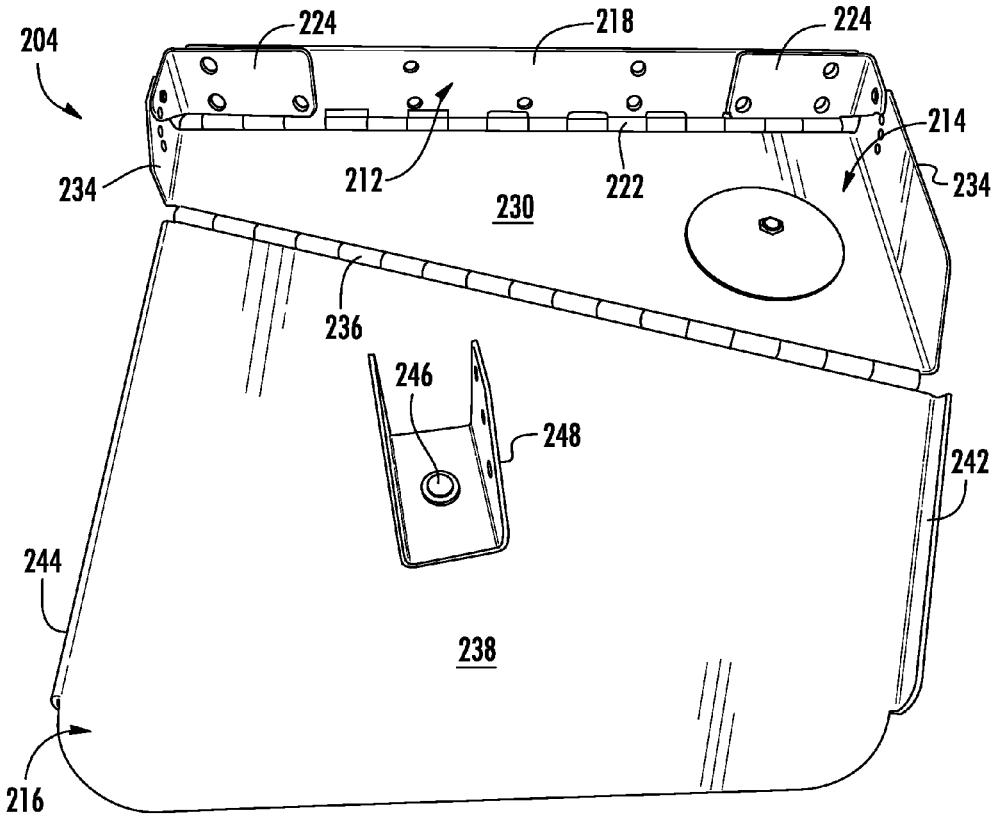
FIG. 5 is a top aft perspective view of the wake adjustment device of FIG. 3.
Figure 6:
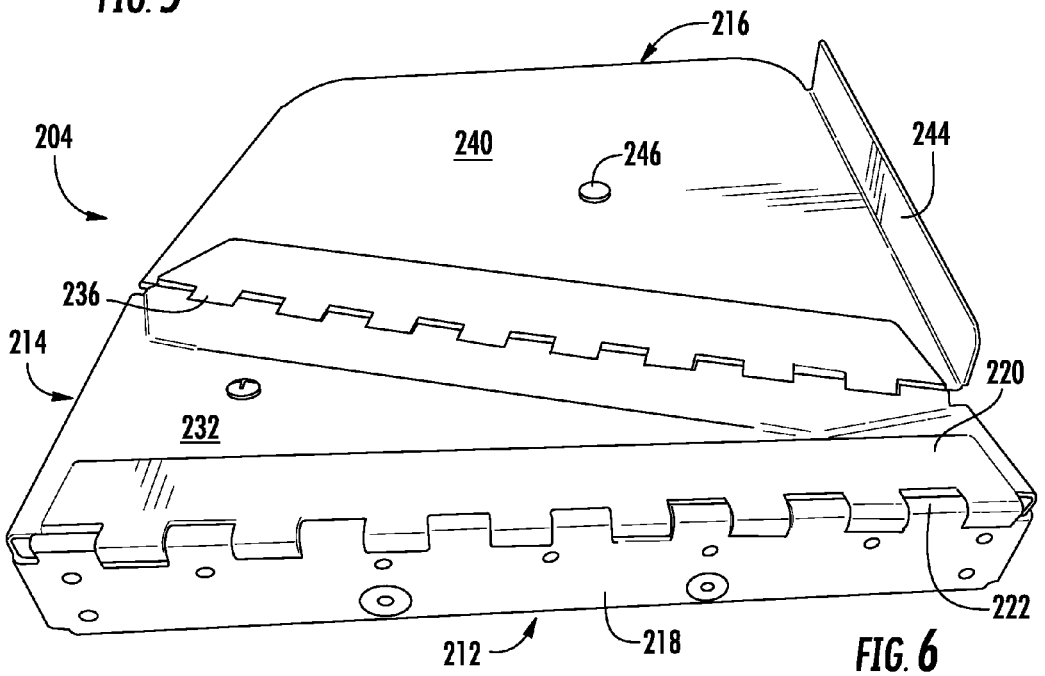
FIG. 6 is a bottom forward perspective view of the wake adjustment device of FIG. 3.
Figure 7:
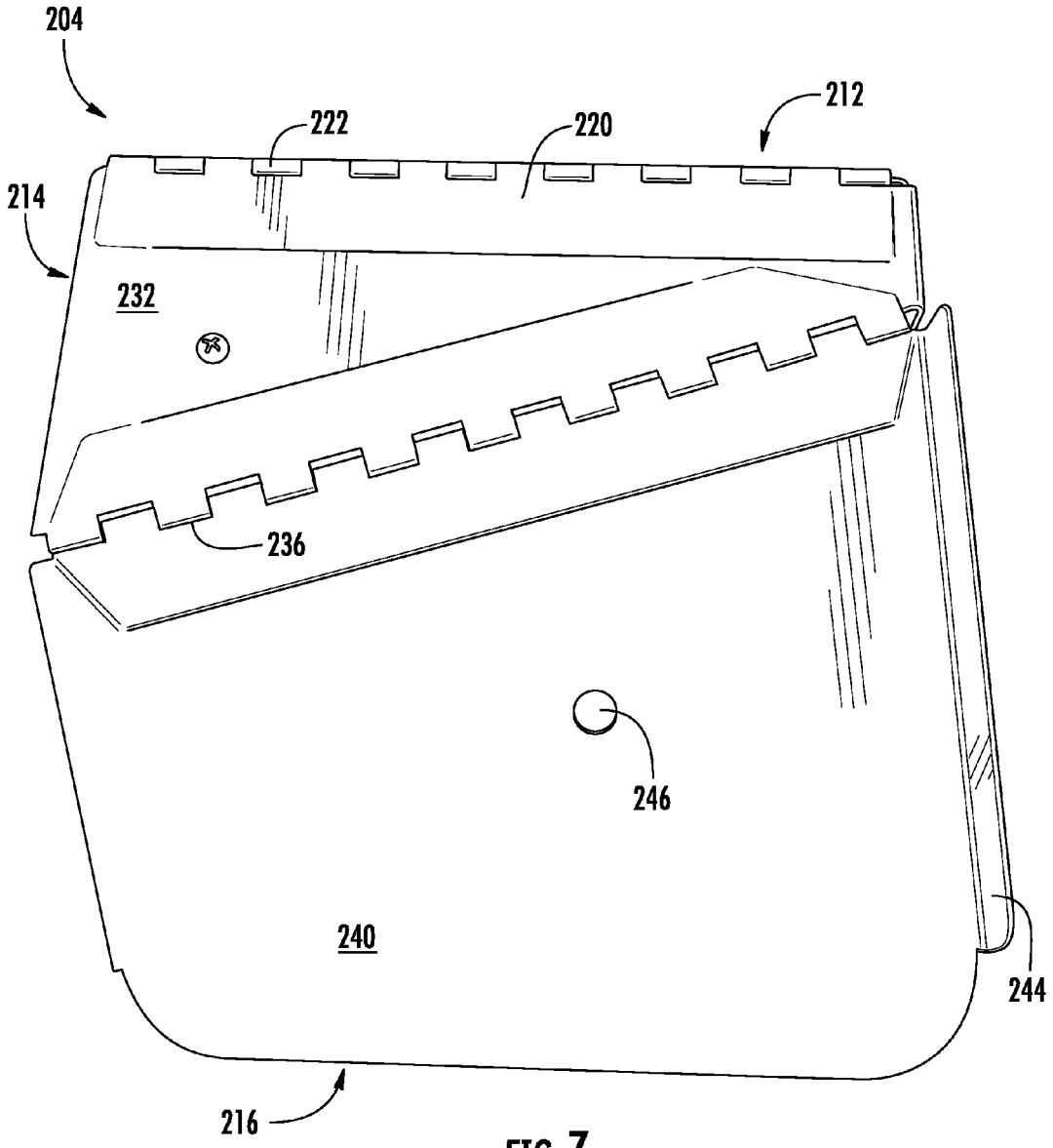
FIG. 7 is a bottom aft perspective view of the wake adjustment device of FIG. 3.
Figure 8:
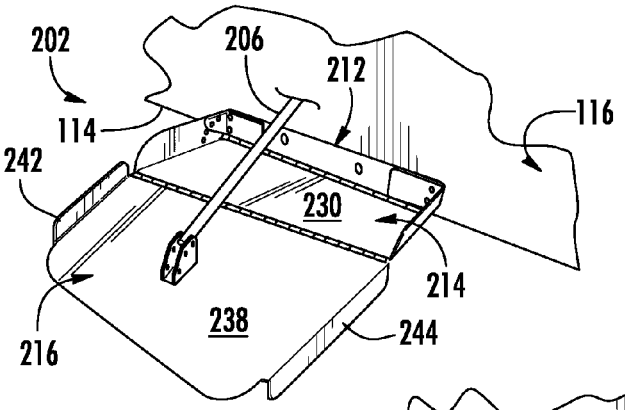
FIG. 8 is an inboard top perspective view of an example of a port side wake adjustment device attached to a boat with the water deflector in a first position.
Figure 9:
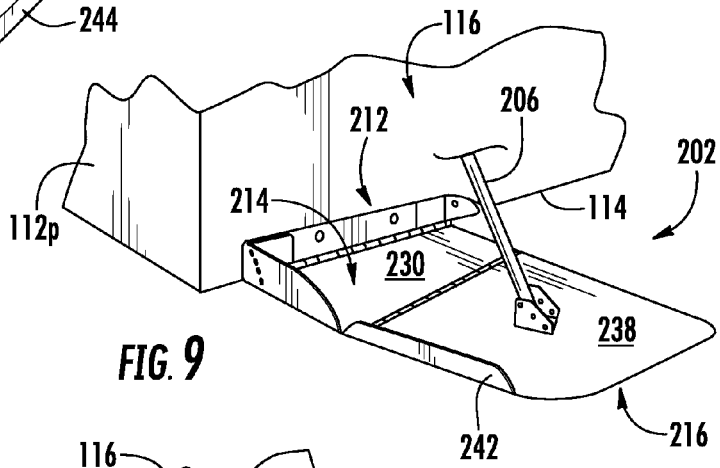
FIG. 9 is an outboard top perspective view of the wake adjustment device of FIG. 8 with the water deflector in the first position.
Figure 10:
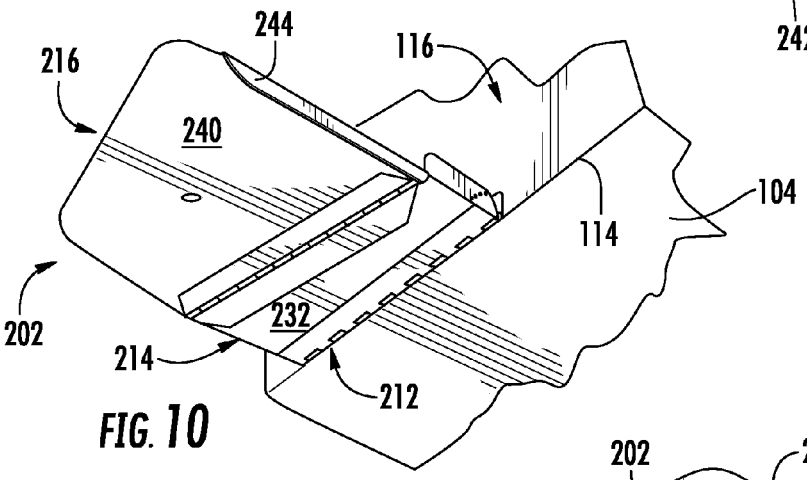
FIG. 10 is an inboard bottom perspective view of the wake adjustment device of FIG. 8 with the water deflector in the first position.
Figure 11:
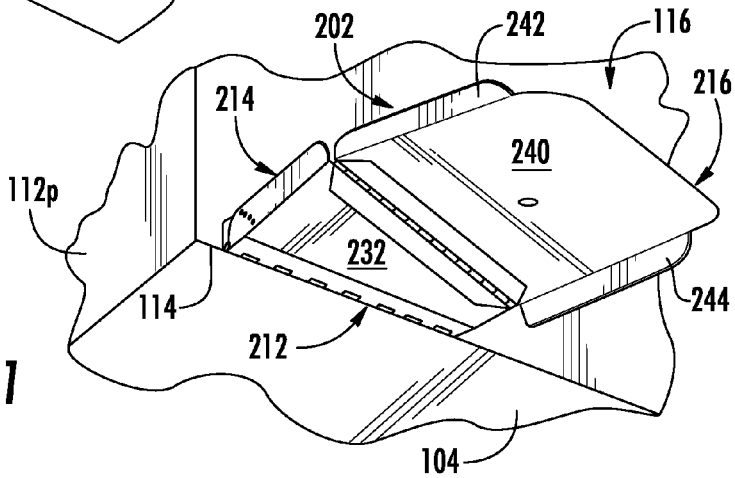
FIG. 11 is an outboard bottom perspective view of the wake adjustment device of FIG. 8 with the water deflector in the first position.
Figure 12:
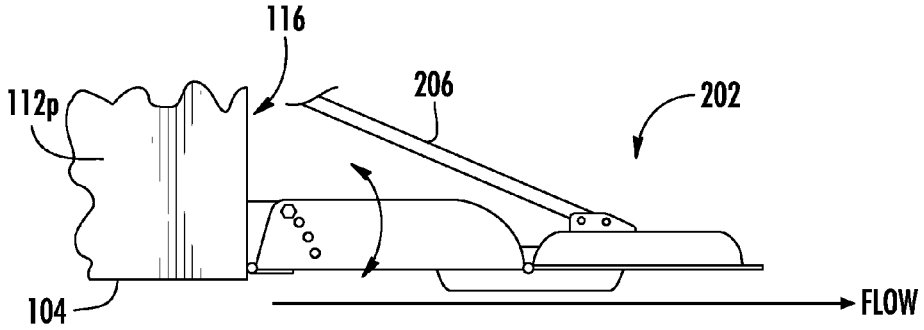
FIG. 12 is an outboard side view of the wake adjustment device of FIG. 8 with the water deflector in the first position.

Referring to FIGS. 1 and 2, a boat 100 includes an example of the wake adjustment system 200. The boat 100 shown is a watersports boat such as those used in water skiing, wake boarding, and/or wake surfing. The boat 100 includes a hull 102 having an underside 103 defining a running surface 104 that contacts the water as the boat moves forwardly across it.

The running surface 104 extends from a bow 106 to a stern 108 along a longitudinal centerline 110 separating port P and starboard S sides. The boat 100 also includes opposed port and starboard sides 112*p*, 112*s* that extend vertically from the underside 103 to port and starboard gunwales 113*p*, 113*s*.

At the rear of the running surface 104 is a stern trailing edge 114 where water releases from the running surface 104 when the boat moves forwardly across it. The stern trailing edge 114 abuts the boat's transom 116 and bisects the centerline 110. The centerline 110 defines a vertical plane 111 dividing the boat in half.

A propeller 118 moves the boat 100 at the desired velocity. The boat 100 drive system may be from an inboard, outboard, an inboard/outboard engine configuration, or any other conventional boat drive system, including, for example, a water jet drive.

The wake adjustment system 200 includes a port side wake adjustment device 202 and a starboard side wake adjustment device 204. Each wake adjustment device 202, 204 is operably connected to an actuator 206 that is capable of moving the wake adjustment device to a desired position for adjusting the size and shape of the wake produced by the boat 100. In the example shown, the actuator 206 is a piston-like device such as those conventionally used to control boat trim tabs.

The actuator 206 is operably connected via control wiring 208 to a control system 210. The control system 210 is a programmable electronic device that allows the boat operator to control the wake adjustment system 200 by inputting desired parameters for the actuator 206.

The wake adjustment devices 202,204 are mounted to the boat 100 aft the stern trailing edge 114. In the example shown, the wake adjustment devices 202,204 are mounted along the transom 116 adjacent the running surface 104. In use, the wake adjustment devices 202,204 deflect water released from the stern trailing edge 114 as the boat 100 moves across the water to affect the boat's wake.

Details of an example of a starboard side wake adjustment device 204 are now described by referring to FIGS. 3-7. The corresponding port side wake adjustment device 202 is a mirror image. The actuator 206 has been removed for clarity. The same reference numerals are used for the port and starboard wake adjustment devices 202,204 to show the same features.

The wake adjustment device 204 includes a mounting member 212 for attaching the device 204 to the boat 100, an extension member 214 extending aft from the mounting member 212, and a water deflector 216 extending aft from the extension member 214.

The mounting member 212 includes a first hinge plate 218 and a second hinge plate 220 connected together at a pivot axis A1 defined by a first hinge 222. The second hinge plate 220 is affixed to the extension member 214 by an affixing mechanism such as fasteners, welds, or the like.

The angle at which the extension member 214 extends aft the running surface 104 may be adjustable. This feature makes the wake adjustment devices 202,204 adaptable to be mounted on boat hulls with different shapes. A pair of opposed brackets 224 are connected to the first hinge plate 218 for adjustably connecting the mounting member 212 to the extension member 214. The forward end of the extension member 214 abuts the first hinge 222. The angle at which the extension member 214 extends aft the running surface 104 is adjustable by rotating the extension plate 214 about the pivot axis A1. The angle may be locked into place by inserting a fastener into corresponding bracket holes 226 and extension member holes 228.

The extension member 214 includes top 230 and bottom 232 extension plate surfaces, which are substantially flat and extend laterally about the stern 108. A pair of opposed extension plate sides 234 are upturned from the extension plate top surface 230 at an angle of between about 70 to 110 degrees or about 90 degrees. The aft end of the extension member 214 includes another pivot axis A2.

The water deflector 216 is connected to the extension member 214 at the other pivot axis A2 via a second hinge 236 affixed to the bottom of the wake adjustment device 204. The water deflector is rotatable about this pivot axis A2 by operating the actuator 206. The water deflector 216 includes a top water deflector surface 238 and a bottom water deflector surface 240, which are substantially flat. An upturned water deflector side stiffener 242 extends upwardly from the top water deflector surface 238 on the outboard side of the water deflector 216. A downturned water deflector side stiffener 244 extends downwardly from the bottom water deflector surface 240 on the inboard side of the water deflector 216. The upturn and downturn angles are between about 70 to 110 degrees or about 90 degrees relative to horizontal.

As shown in FIG. 2, the water deflector pivot axis A2 forms an acute angle a with a vertical plane defined by the centerline when it is projected onto the plane. Because of this angle, when the water deflectors 216 rotate downwardly, they deflect water in the outboard direction as the boat moves forward, which affects the wake. The arrows represent the outboard direction of water deflection. The degree of angle a may be, for example, 50 to 85 degrees or 60 to 80 degrees.

FIGS. 8-11, 12, and 14 show the water deflector 216 of the port side wake adjustment device 202 in a first position in which the angle about the axis A2 is substantially zero. In this position, when the boat is planning, the water deflector 216 has a minimal effect on the wake because the water deflector 216 is does not substantially deflect water leaving the stern trailing edge 114.

Figure 13:
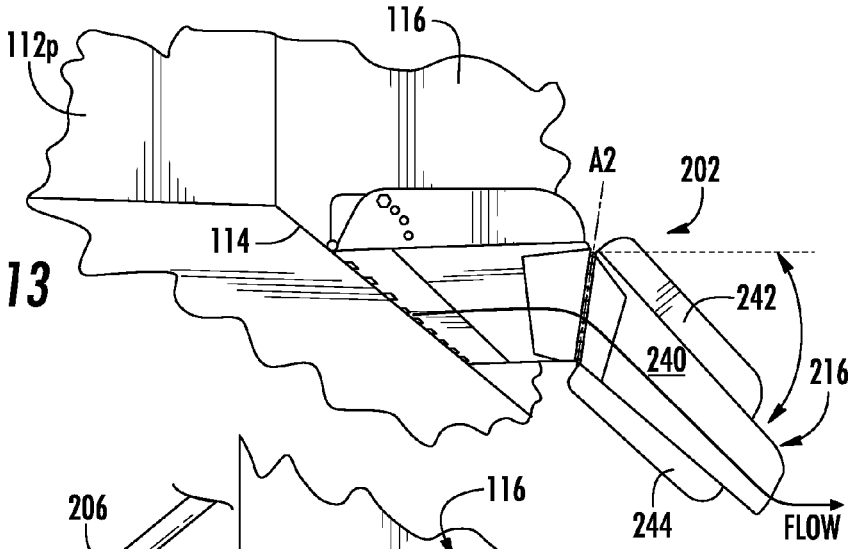
FIG. 13 is an outboard bottom perspective view of the wake adjustment device of FIG. 8 with the water deflector in a second position.
Figure 14:
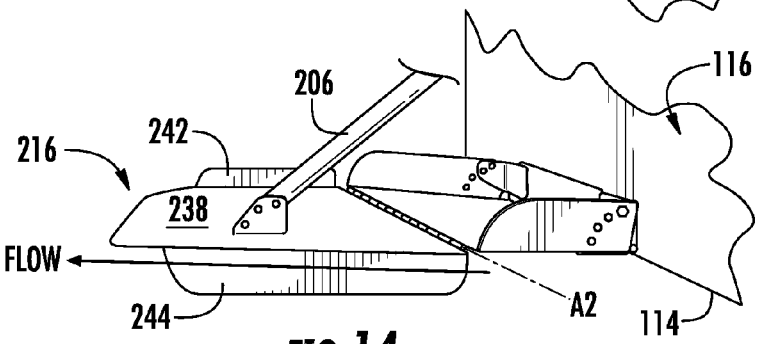
FIG. 14 is an inboard top perspective view of the wake adjustment device of FIG. 8 with the water deflector in the first position.
Figure 15:
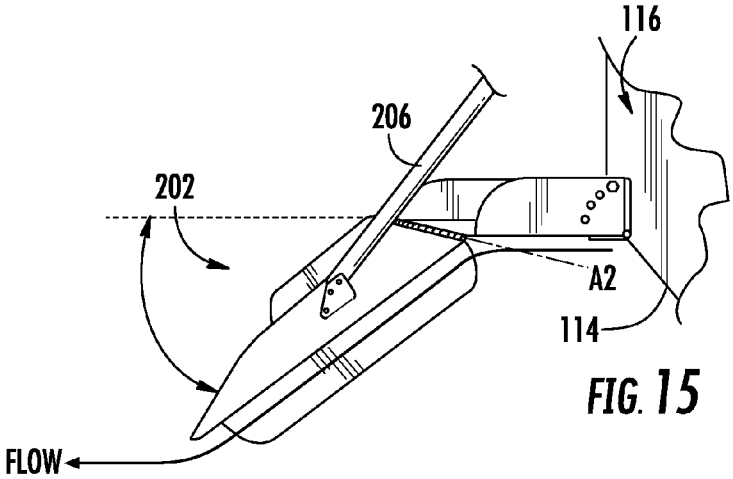
FIG. 15 is an inboard top perspective view of the wake adjustment device of FIG. 8 with the water deflector in the second position.

FIGS. 13 and 15 show the water deflector 216 in a second position in which the angle about the axis A2 is acute such that the water deflector 216 angles downwardly. When the water deflector 216 is in the second position and the boat 100 moves forward, the water deflector 216 deflects the water that released from the stern trailing edge 114 downwardly and in the outboard direction, effectively digging a hole in the water behind the boat 100.

The wake adjustment system 200 may advantageously be used to form a surf wake behind the boat 100. A surf wake is a wake having a height and shape sufficient to propel a surfer behind the boat without a tow rope. In order to form a surf wake, one of the two wake adjustment devices 202,204 is activated such that the water deflector 216 is angled down into the water at the second position.

The actuator 206 is attached to the wake adjustment device 202,204 at an actuator connection bracket 248. Referring back to FIG. 4, the actuator connection bracket 248 is attached to the water deflector 204 at the actuator connection point 246. The actuator connection bracket 248 is rotatable about the vertical axis passing through it as illustrated. This allows the actuator 206 to be attached to different positions on the boat 100, such as the transom 116 or bottom of the swim platform (not shown).

The actuator 206 may be attached to the bracket 248 at any of the plurality of piston connection points 250. Attaching the actuator 206 to a different piston connection point 250, changes the degree by which the water deflector 216 is able to rotate about the axis A2. This advantageously provides additional adjustability for installing on many different types of boats 100 with different hull designs.

The height and shape of the wake is adjustable by instructing the control system 210 to modify the angle about the water deflector axis A2 by adjusting the actuator's 206 degree of extension.

Figure 16:
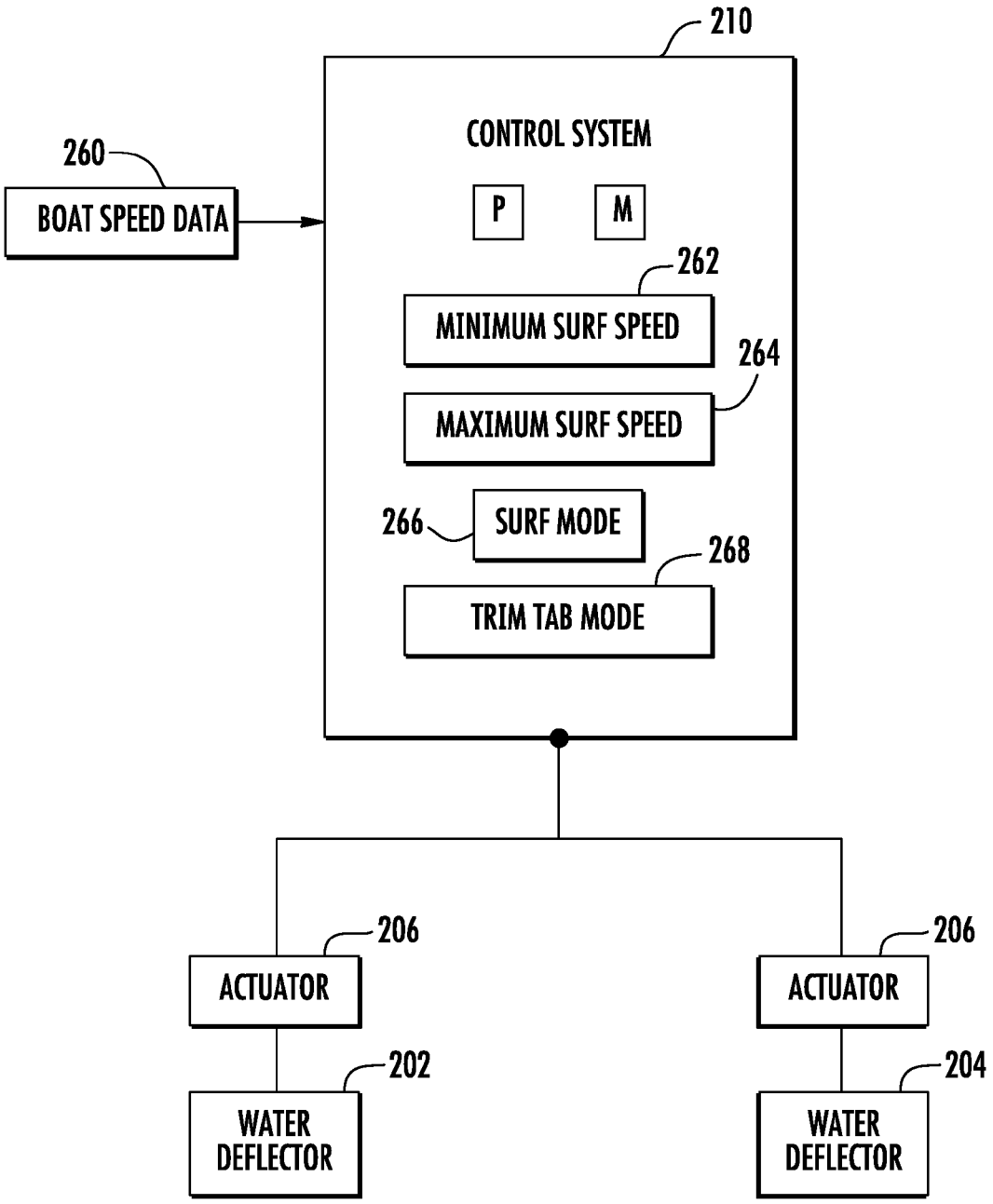
FIG. 16 is a block diagram illustrating a control system aspect.

Some exemplary functions of the control system 210 are now described with reference to FIG. 16. The control system 210 is generally operable to cause the actuators 206 to extend and retract to vary the water deflectors' 216 angle of rotation about axis A2. Certain embodiments of the control system 210 are configured to control the movement of the water deflectors 216 such that they can operate as wake surf-generating devices and as trim tabs.

The control system 210 stores program instructions on non-transitory processor readable memory M such as a magnetic memory device or the like. The control system 210 also includes a processor P that executes the program instructions. The processor P may be a computer-type processor such as a microprocessor.

The memory M includes program instructions that the processor P executes to control the actuators 206 according to different operational modes that the control system 210 via the processor P selects based on the boat's speed. The boat's speed corresponds to boat speed data 260, which is input into the control system 210 from a speedometer or the like adapted to measure the boat's speed. The memory M stores a preset minimum surf speed 262 and a preset maximum surf speed 264.

The operational modes include a surf mode 266 and a trim tab mode 268. These operational modes are governed by the program instructions on the memory M and are executed by the processor P.

When the boat is moving at a speed below the minimum surf speed 262, the processor P will cause the actuators 206 to be retracted to a non-surf position. In the non-surf position, the water deflectors 216 do not substantially deflect water that has moved past the stern trailing edge 114. An example of a preset minimum surf speed is about 5 mph.

The processor P selects surf mode 266 as the operational mode when the boat's speed at a suitable and safe wake surfing speed, which is at or above the minimum surfing speed 262 up to and including the maximum surfing speed 264. In surf mode 266, the actuators 206 may be controlled manually by the boat operator by inputting the angle A2 of rotation that provides the desired surf wake. When one of the water deflectors 216 is rotated downward into a surfing position so that it deflects water substantially enough to create a surf wake, the control system 210 will move the other water deflector 216 to the non-surf position automatically. An example of a maximum surf speed is 19 mph.

The processor P selects trim tab mode 268 when the boat is moving at a speed greater than the maximum surf speed 264. The processor P will cause both water deflectors 216 to rotate to the non-surf position if either of the water deflectors 216 was in a surf position when the maximum surf speed 264 is exceeded.

In trim tab mode 268, the processor P advantageously operates the water deflectors 216 as conventional boat trim tabs that generate lift at the stern of the boat to adjust the boat's ride and planing angle. In trim tab mode 268, the control system 210 will restrict the angle of rotation about axis A2 so that the water deflectors 216 will only rotate a portion of their full rotational range of motion. If the full rotational range of motion about axis A2 is expressed as 100%, for example, the restricted range of motion in trim tab mode may be 1% to 50%, 1% to 40%, 1% to 30%, 1% to 25%, or 1% to 20%. The percentage refers to the percentage rotation about axis A2 relative to the full range of motion.

By way of example, if the full rotational range of motion of the water deflectors 216 is 90 degrees and the restricted range of motion is set to 25%, then, in trim tab mode 268, the water deflectors 216 will only be able to rotate downwardly by 25% of 90 degrees or by 22.5 degrees.

Figure 17:
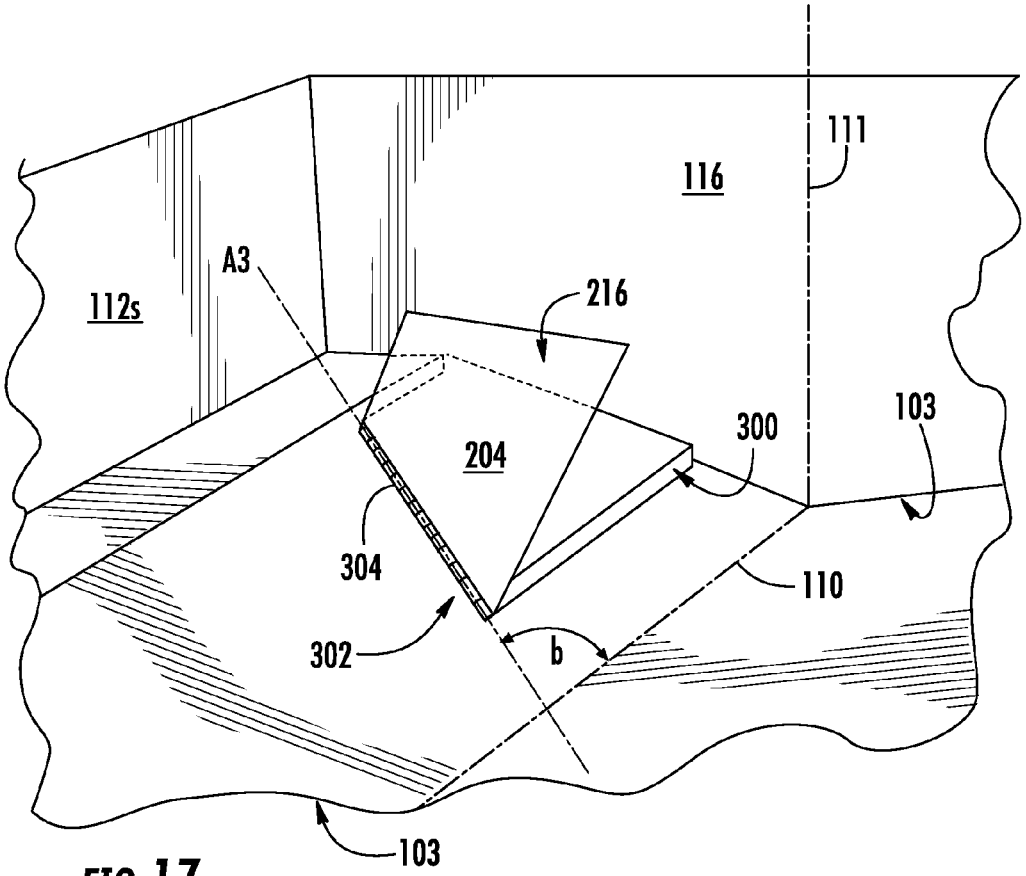
FIG. 17 is a cutaway view showing an alternate arrangement for a wake adjustment device.

FIG. 17 shows an alternate arrangement for attaching a wake adjustment device 204 to a boat 100. In the arrangement shown, the wake adjustment device 204 includes a water deflector 216 mounted in a recess 300 in the running surface 104. The forward edge 302 of the recess 300 includes a pivot axis A3 formed by a hinge 304. The forward edge 302 angles inwardly at an angle b relative to the centerline 110.

Figure 18:
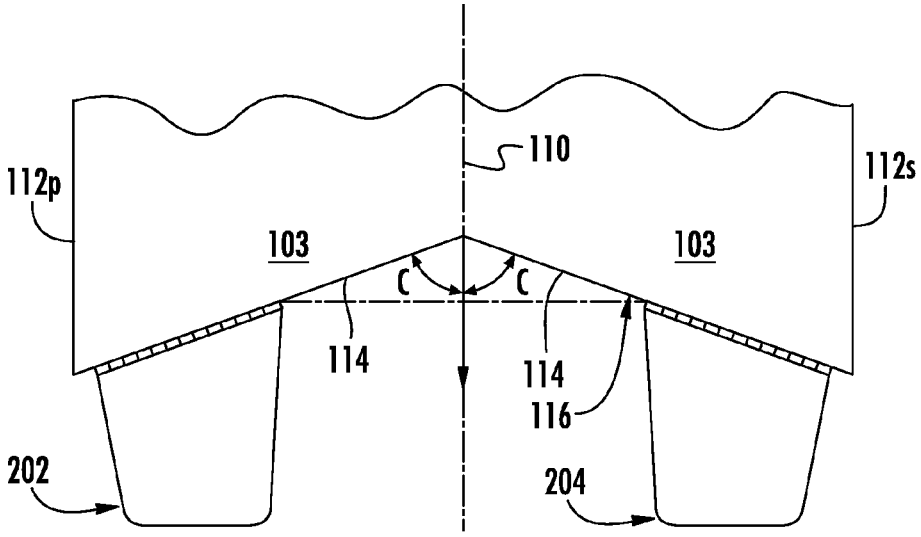
FIG. 18 is a cutaway view showing another alternate arrangement for a wake adjustment device.

FIG. 18 shows another alternate arrangement for attaching a wake adjustment device 202, 204 to a boat. In the arrangement shown, the wake adjustment devices 202, 204 are mounted to the boat 100 about the stern trailing edge 114. The stern trailing edge 114 is angled inwardly and intersects the centerline 110 at angle c. Such an arrangement is useful for boats that may have this type of stern configuration.

This disclosure describes certain aspects and examples, but not all possible aspects or examples of the boat, wake adjustment system, wake adjustment device, or control system. Where a particular feature is disclosed in the context of a particular example, that feature can also be used, to the extent possible, in combination with and/or in the context of other examples. The boat, wake adjustment system, wake adjustment device, and control system may take many different forms and should not be construed as limited to only the examples described here.

That which is claimed is:

1. A boat comprising:

a hull having a bottom side with a running surface extending from a bow to a stern along a longitudinal hull centerline, the running surface having a trailing edge at the stern where water releases from the running surface when the boat moves forward though water;

a pair of wake adjustment devices mounted to the boat aft the stern trailing edge in opposed positions about the centerline, each wake adjustment device having a water deflector pivotally attached to the wake adjustment device along a first pivot axis that is non-parallel with the stern trailing edge, each water deflector being rotatable about the first pivot axis so as to modify the boat's wake; and a control system in communication with each wake adjustment device, the control system being operable to impart rotation about each first pivot axis to each water deflector independent of the other water deflector to make a surf wake behind the boat.

2. The boat of claim 1, wherein the stern trailing edge is formed where the running surface meets a transom of the boat and the first pivot axis extends horizontally across the wake adjustment device.

3. The boat of claim 1, wherein the first pivot axis angles inboard toward a vertical plane defined by the centerline so as to deflect water in an outboard direction when the boat moves forward through water.

4. The boat of claim 3, wherein the first pivot axis projected onto the vertical plane forms an acute angle with the vertical plane.

5. The boat of claim 3, wherein the first pivot axis projected onto the vertical plane forms an acute angle of 50 to 85 degrees with the vertical plane.

6. The boat of claim 1, wherein each wake adjustment device is rotatable about a second pivot axis positioned forward the first pivot axis.

7. The boat of claim 1, wherein each wake adjustment device further includes:

a mounting member mounting the device to the boat;

an extension member connected to the mounting member and extending aft the mounting member, the first pivot axis extending across the extension member; and a second pivot axis forming the connection between the mounting member and extension member.

8. The boat of claim 7, wherein the extension member is a substantially horizontally oriented plate having a bottom surface that can be positioned substantially coplanar with the running surface immediately forward the stern trailing edge by rotation about the second pivot axis.

9. The boat of claim 1, wherein each water deflector is rotatable upwardly and downwardly about the first pivot axis.

10. A wake adjustment system for a boat including a hull having a bottom side with a running surface extending from a bow to a stern along a longitudinal hull centerline, the wake adjustment system comprising:

a pair of wake adjustment devices mountable to the stern in opposed positions about the centerline, each wake adjustment device having:

(i) a mounting member at a forward end of the device that can mount the device to the boat;

(ii) an extension member having a forward edge connected to the mounting member, the extension member extending aft the mounting member to a first pivot axis extending horizontally across the extension member from an outboard side to an inboard side thereof, the first pivot axis being non-parallel to the forward edge of the extension member; and (iii) a water deflector connected to the extension member at the first pivot axis, the water deflector being rotatable about the first pivot axis for varying a degree of wake adjustment.

11. The wake adjustment system of claim 10, wherein the first pivot axis angles in an inboard and forward direction so as to allow the water deflector to deflect water in an outboard direction.

12. The wake adjustment system of claim 10, wherein the first pivot axis angles in an inboard and forward direction to form an acute angle with a vertical plane defined by the centerline when the wake adjustment devices are mounted to the boat.

13. The wake adjustment system of claim 10, wherein the first pivot axis angles in an inboard and forward direction to form an acute angle of 50 to 85 degrees with a vertical plane defined by the centerline when the wake adjustment devices are mounted to the boat.

14. The wake adjustment system of claim 10, wherein each wake adjustment device is rotatable about a second pivot axis positioned forward the first pivot axis.

15. The wake adjustment system of claim 10, wherein each wake adjustment device further includes a second pivot axis forming a connection between the mounting member and extension member.

16. The wake adjustment system of claim 10, wherein the extension member is a substantially horizontally oriented plate having a bottom surface that can be positioned substantially coplanar with the running surface immediately forward the stern trailing edge by rotation about a second pivot axis positioned forward the first pivot axis.

17. A method of generating a surf wake behind a boat including a hull having a bottom side with a running surface extending from a bow to a stern along a longitudinal hull centerline, the running surface having a trailing edge at the stern where water releases from the running surface when the boat moves forward though water, the method comprising:

imparting rotation to a water deflector of a wake adjustment device mounted to a stern of a boat on either a port or starboard side of the centerline in such a way that the water deflector deflects water that moved past the stern trailing edge and creates a surf wake behind the boat;

the water deflector being rotatably connected to the wake adjustment device at a first pivot axis that extends horizontally across the wake adjustment device and is non-parallel with the stern trailing edge.

18. The method of claim 17, wherein the first pivot axis angles inboard toward a vertical plane defined by the centerline so as to deflect water in an outboard direction when the boat moves forward through water.

19. The method of claim 18, wherein the first pivot axis projected onto the vertical plane forms an acute angle with the vertical plane.

20. The method of claim 19, wherein the first pivot axis projected onto the vertical plane forms an acute angle of 50 to 85 degrees with the vertical plane.

21. The method of claim 17, wherein the wake adjustment device is rotatable about a second pivot axis positioned forward the first pivot axis.

22. The method of claim 17, wherein the wake adjustment device includes:

a mounting member mounting the device to the boat;

an extension member connected to the mounting member and extending aft the mounting member, the first pivot axis extending across the extension member; and a second pivot axis forming the connection between the mounting member and extension member.

23. The method of claim 22, wherein the extension member is a substantially horizontally oriented plate having a bottom surface that can be positioned substantially coplanar with the running surface immediately forward the stern trailing edge by rotation about the second pivot axis.

24. The method of claim 17, wherein the water deflector is rotatable upwardly and downwardly about the first pivot axis.

25. A boat control system for a boat including a hull having a bottom side with a running surface extending from a bow to a stern along a longitudinal hull centerline, the running surface having a trailing edge at the stern where water releases from the running surface when the boat moves forward though water, the boat including port and starboard side water deflectors mounted at the stern in such a way that the water deflectors can deflect water that moves past the stern trailing edge, the boat control system comprising:

a non-transitory processor readable memory medium storing a maximum surfing speed and processor instructions that are executable to cause a processor to (a) receive boat speed data from the boat and (b) select an operational mode for controlling movement of the water deflectors based on the boat speed data, the operational modes including:

(i) a surf mode wherein the water deflectors are operational to rotate through a first range of rotation and create a surf wake behind the boat up to the maximum surfing speed; and (ii) a trim tab mode wherein the water deflectors are operational to rotate through a second range of rotation that is restricted relative to the first range of rotation above the maximum surfing speed.

* * * * *